US006491169B1

(12) United States Patent
Salonen

(10) Patent No.: US 6,491,169 B1
(45) Date of Patent: Dec. 10, 2002

(54) CLOTHES RACK

(75) Inventor: Arto Salonen, Tampere (FI)

(73) Assignee: S.I. Treducon Oy, Tampere (FI)

( * ) Notice: Subject to any disclaimer, the term of this patent is extended or adjusted under 35 U.S.C. 154(b) by 0 days.

(21) Appl. No.: 09/786,464

(22) PCT Filed: Sep. 1, 1999

(86) PCT No.: PCT/FI99/00712

§ 371 (c)(1),
(2), (4) Date: Mar. 5, 2001

(87) PCT Pub. No.: WO00/14370

PCT Pub. Date: Mar. 16, 2000

(30) Foreign Application Priority Data

Sep. 4, 1998 (FI) ..... 981896

(51) Int. Cl.[7] ..... E05B 73/00
(52) U.S. Cl. ..... 211/4
(58) Field of Search ..... 211/4, 6, 8, 9, 211/1.51, 1.57

(56) References Cited

U.S. PATENT DOCUMENTS

| | | | | |
|---|---|---|---|---|
| 695,019 | A | | 3/1902 | White |
| 725,441 | A | | 4/1903 | Hart |
| 819,311 | A | | 5/1906 | Purvis |
| 833,909 | A | | 10/1906 | Ashley |
| 892,407 | A | | 7/1908 | Courtney |
| 4,805,781 | A | * | 2/1989 | Tegel |
| 5,011,054 | A | | 4/1991 | Mauffette |
| 5,040,385 | A | * | 8/1991 | Randone |
| 5,848,710 | A | * | 12/1998 | Pomper |
| 6,330,815 | B1 | * | 12/2001 | Duncan |

FOREIGN PATENT DOCUMENTS

| | | |
|---|---|---|
| CH | 395 781 | 5/1962 |
| CH | 470 570 | 2/1968 |
| DE | 1 579 495 | 8/1970 |
| DE | 26 05 831 | 8/1977 |
| DE | 68618 | 10/1992 |
| EP | 0 246 702 | 11/1987 |
| FI | 82523 | 12/1988 |
| FI | 83803 | 12/1988 |
| FI | 106360 B | 9/1998 |
| SE | 29634 | 10/1909 |
| WO | 90/07046 | 6/1990 |

* cited by examiner

*Primary Examiner*—Alvin Chin-Shue
*Assistant Examiner*—Sarah Purol
(74) *Attorney, Agent, or Firm*—Young & Thompson

(57) ABSTRACT

The invention relates to a clothes rack for keeping garments, bags and other such objects. The clothes rack comprises a locking bow (1) arranged to move with respect to a fastening frame (4) by means of a power unit (7) and moving elements connected thereto, and to press the objects to be kept against the fastening frame (4), whereby the objects cannot be stolen from between the locking bow (1) and the fastening frame (4). The self-locking moving elements that are designed to hold the locking bow (1) in its locking position although et power unit (7) is switched off prevent the locking bow (1) from being unauthorizedly unlocked.

9 Claims, 2 Drawing Sheets

CLOTHES RACK

Figure 1:
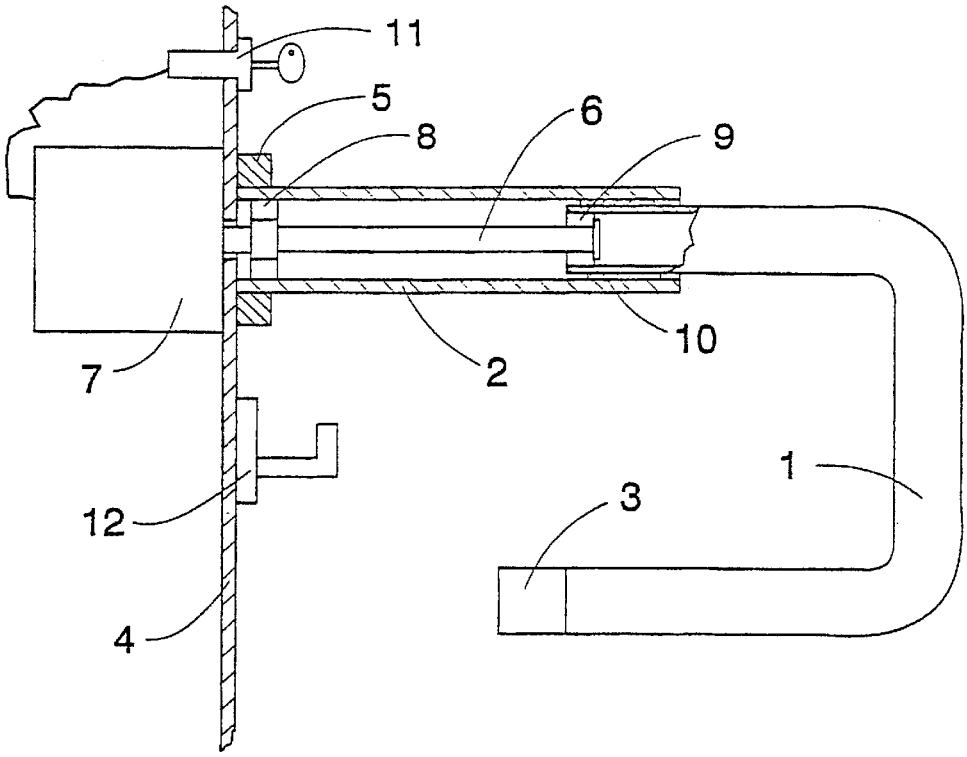

The invention relates to a clothes rack for keeping garments, bags and other necessary objects, which clothes rack comprises a frame, and a movable locking part for connecting and/or locking the objects to the clothes rack, and means for moving the locking part, which is a locking bow. arranged to be movable with respect to the fastening frame.

A cloakroom in public buildings, restaurants, companies and other such premises can either be a manned cloakroom or an unguarded self-service type of cloakroom. For cost reasons, however, it is not feasible in most places to organize a guarded cloakroom service. It is always risky to leave particularly valuable clothes, such as leather jackets and fur coats, in an unguarded clothes rack. Nevertheless, losing even less valuable garments is also harmful to the owner. Since garments are increasingly being stolen, many communities, institutions and companies have started paying more attention to cloakroom services, because their public image includes the idea of them being responsible for keeping their customers' property intact. Hence, a need for a lockable self-service clothes rack exists. On the other hand, renting the safety clothes racks, as they could be called, offers athletic clubs, societies and the like a great opportunity to raise funds. Those who own the safety clothes racks then fit them in the customer's premises, thereby enabling the customer to improve the customer service and safety while those who rent the clothes rack can raise money to finance their activities.

A structural solution for the lockable clothes rack comprises a frame, a hanger attached to the frame and a wire, metal string, chain or other such locking part attached to the frame from its first end, and further, a lock device for locking the free end of the locking part. By means of such a clothes rack, a piece of clothing with an opening of any kind can be locked in such a manner that the locking part is slid through the opening, for example through an opening formed by a coat sleeve or a bag handle, and subsequently, the free end of the locking part is locked by means of the lock device such that the locked object cannot be unauthorizedly removed from the clothes rack. A disadvantage presented by the lockable clothes rack is, however, that only objects with said opening can be fastened thereto. In practice, it is thus impossible to lock headgear, gloves, scarves and the like to the clothes rack. A further disadvantage is that to use such a clothes rack solution which requires the sliding the locking part is time-consuming and difficult, which means that the clothes rack will not be actually used, at least not in the designed manner. The most serious disadvantage is, however, that the apparatus cannot guarantee sufficiently safe cloakroom services since the locking part, most often the wire, metal string or chain, can quite easily, quickly and silently be cut using wire cutters, for example, after which the locked object can be stolen from the clothes rack.

Furthermore, CH 470 570 discloses a lockable and collapsible clothes hanger comprising hinged suspension arms that can be inserted into coat sleeves and spread and locked such that the garment cannot be unauthorizedly removed from the hanger. The frame of the clothes hanger further comprises a lockable pressing part equipped with serrated clamps between which the garment can be clamped and locked. However, the clothes hanger is rather difficult and slow to use. In addition, the pressing part disclosed in said publication with its serrated clamps is rather rough on the garment to be fastened, thereby easily causing damage to clothes made of fine material in particular.

DE 26 05 831 discloses a clothes rack with a lockable suspension hook comprising a ball head hook in the lower part and a cupped hook in the upper part, which is turnable with respect to its hinges and which can be locked in a locking position wherein the cup of the cup-head hook of the upper part is pressed against the ball surface of the ball head hook of the lower part such that a garment hanging on the lower part hook by its suspension loop or other such part cannot be unauthorizedly taken. Such clothes racks based on locking the garments by their suspension loops, however, suffer from the disadvantage that the garments can easily be stolen therefrom by cutting the suspension loop or the like without, however, substantially damaging the stolen garment. Moreover, the suspension loop can be easily mended.

FI 83803 discloses a lockable clothes and bag hanger wherein garments are locked between clamping jaws and a bag can be hung by its strap from a loop part formed by the hanger. The hanger comprises a movable jaw and a screw mechanism whereby the movable jaw is pressed against a fixed jaw. The pressing, as well as the unpressing, can be carried out by rotating a handwheel, provided that the lock cylinder pins are opened by using a key. Such an apparatus, however, suffers from the disadvantage that, since the upper jaw is turnable with respect to its hinges, the hanger can rather easily be unlocked by wrenching the turnable jaw and the fixed jaw apart from each other with a suitable bar, for example, in which case the jaws are no longer able to clamp and lock the garment. This procedure can be carried out very quickly and silently. The use of the apparatus is also restricted by the fact that when the thickness of the garments to be locked varies significantly, it can be distressingly slow to lock the garments by rotating the handwheel.

An object of the invention is to provide a clothes rack which is reliable, simple and quick to use and suitable for keeping garments, bags and other objects safely in the clothes rack.

The clothes rack of the invention is characterized in that a power unit is connected to the fastening frame, which power unit is arranged to convey the locking bow into a locking position by means of moving elements.

A substantial idea underlying the invention is that locking objects to a clothes rack is carried out by means of a locking bow arranged to be movable with respect to a fastening frame and arranged to press the objects against the fastening frame such that they cannot be removed from the clothes rack unathorizedly. Furthermore, it is substantial that a power unit is arranged in the clothes rack for moving the locking bow, the power unit causing the locking bow to move between an unlocking position and a locking position, and further, generating a sufficient force to press the locking bow. Furthermore, a substantial idea underlying a preferred embodiment of the invention is that the locking bow is arranged to press an object to be locked against a substantially planar counter surface, in which case to move the locking bow in the lateral direction does not substantially affect the locking of the object. It is a further substantial idea of a second preferred embodiment of the invention that the moving apparatus is designed to be capable of keeping the locking bow in the locking position even while the power unit is switched off. An idea of a third embodiment of the invention is that the power unit is an electric motor and that the moving apparatus included in the clothes rack comprises a screw arranged to be rotated by the motor and a matching nut attached to the locking bow. A substantial idea of a fourth embodiment of the invention is that the moving elements comprise a self-locking toothed wheel for rotating the power unit and a self-locking toothed bar connected to the locking bow from its first end. An idea of another embodiment is that the moving elements comprise a thin drive belt arranged to be rolled by the power unit, which belt is supported at suitable intervals in order to prevent the belt from bending, the first end of the belt being connected to the locking bow.

An advantage provided by the invention is that it is suitable for locking garments, bags, etc. of all kinds. In principle, everything that can be at least to some extent pressed locally can be locked using the apparatus of the invention. Hence, the apparatus of the invention is versatile and safer than most prior art devices. The clothes rack of the invention is easy and quick to use, which means that in practice it is actually used; no risk that it would not be used exists. Automatic functions increase the user-friendliness. A further advantage is provided by the small size, particularly by the fact that the clothes rack requires crucially less space in the lateral direction than the prior art clothes rack solutions do. Consequently, many more clothes racks of the invention can be arranged in a given space than the known clothes racks. Hence, the apparatus of the invention saves space much more efficiently. Furthermore, the advantageous appearance and interesting operating principle of the apparatus combine to make the apparatus desirable and widely used. A still further advantage is that, thanks to its structure and operating principle, the apparatus is highly thiefproof. The power unit and the moving elements are well protected, the locking bow is made of firm material and the entire apparatus is rigidly fastened. A further advantage is that the pressing force of the locking does not depend on the user or the operating life of the apparatus since the apparatus is automatically locked and does not contain springs that become increasingly ineffective with time. The clothes rack of the invention further has the advantage that various electric functions can be connected to the operation of the clothes rack in a simple manner. Such functions include occupied/unoccupied detectors and burglar alarms.

Figure 2:
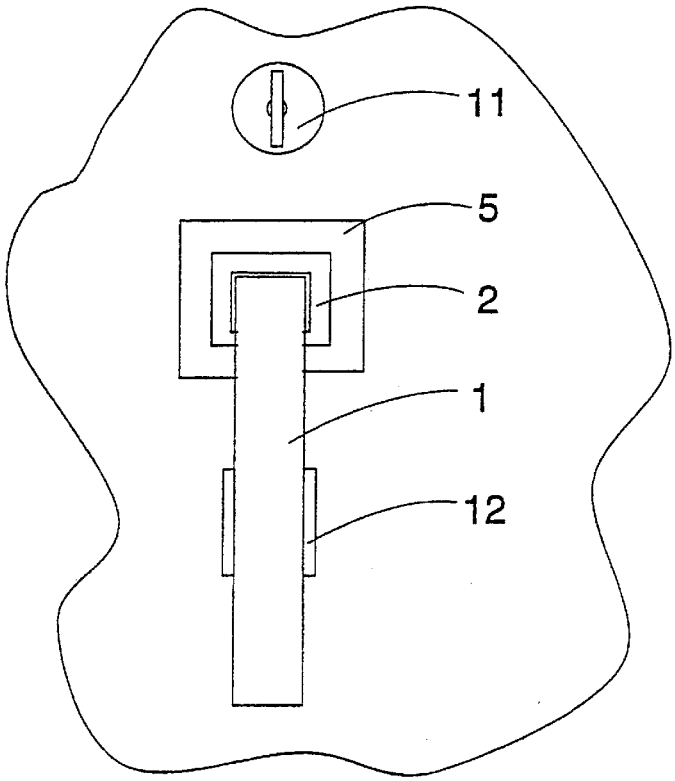
Figure 3:
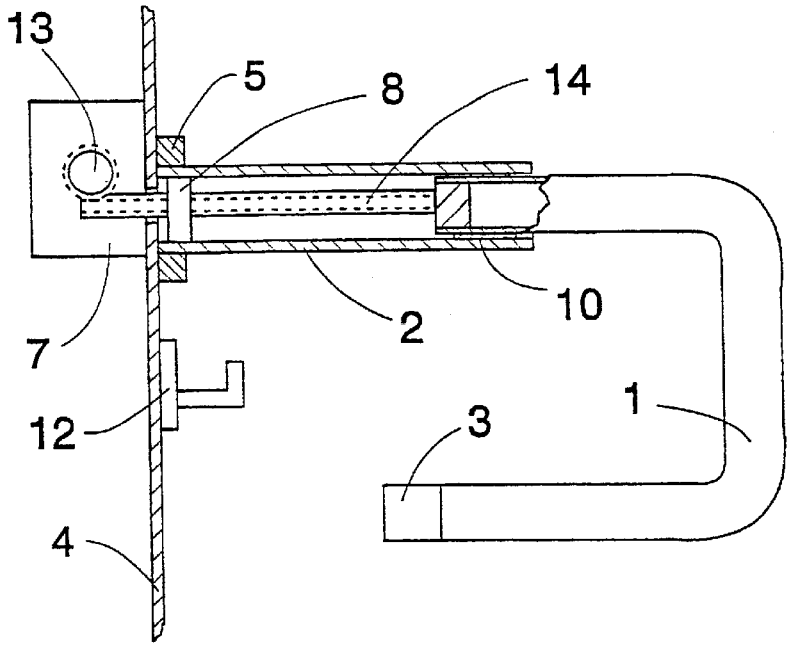
Figure 4:
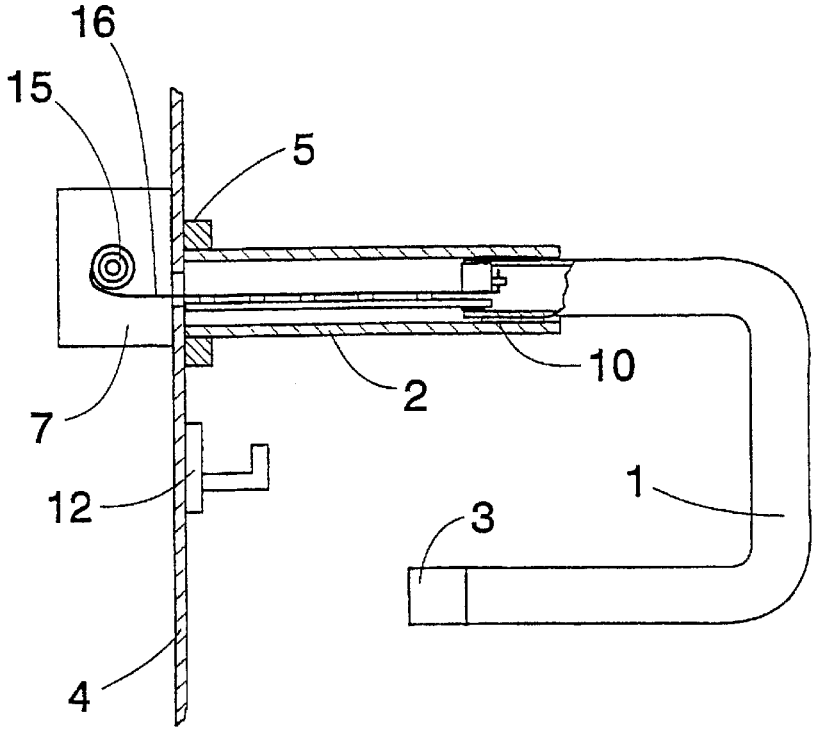

The invention is described in closer detail in the accompanying drawings, in which FIG. 1 is a schematic, partly sectional side view of an embodiment of a clothes rack of the invention, FIG. 2 is a schematic front view of the clothes rack of the invention shown in FIG. 1, FIG. 3 is a schematic, partly sectional side view of a second embodiment of the clothes rack of the invention, and FIG. 4 is a schematic, partly sectional side view of a third embodiment of the clothes rack of the invention.

FIG. 1 is a schematic, partly sectional side view of an embodiment of a clothes rack of the invention. The clothes rack comprises a locking bow 1, which serves as a locking part and which is preferably a U-shaped part made of a metal tube with a square cross-section. The square form of the cross-section is preferable because together with a locking frame 2 with a square cross-section, at least partly arranged within each other, they prevent the locking bow 1 from being moved in the lateral direction with respect to the locking frame 2. If cross-sectional forms of the locking bow 1 and the locking frame 2 are used which do not prevent the locking bow 1 from being moved in the lateral direction, a pin can be arranged in the locking bow 1, for example, and a groove in the locking frame 2, respectively, to enable the to-and-from movement of the locking bow 1 but which prevent the locking bow from being moved in the lateral direction. The locking bow 1 is naturally made of sufficiently strong material so that it cannot be bent manually. In addition to the tube, the locking bow 1 can be made of solid material; also other than metallic materials can be used. In the present presentation, the locking bow refers to all locking parts movable and lockable in the manner according to the invention. The end of the locking bow 1 to be arranged against the object to be locked there is provided with a cushion 3 to make the locking more efficient and to prevent fragile objects from being damaged when pressed against a fastening frame 4. The cushion 3 can be made of plastic material, rubber or compound rubber. It is preferable to use a cushion 3 made of soft rubber with advantageous friction characteristics in view of the locking. The tube-like locking frame 2 preferably with a square cross-section is immovably secured to the fastening frame 4 by, for example, welding it firmly together with the fastening frame 4. A ring-shaped support flange 5 is attached around the locking frame 2 by welding, for example, primarily to guarantee a firm and thiefproof attachment of the locking frame 2 to the fastening frame 4. An opening is provided for the moving elements in the fastening frame 4 at the locking frame 2. On the opposite side of the fastening frame 4, protected from any potential use of force, a power unit 7, preferably an electric motor, is arranged which is connected to rotate a screw 6 connected thereto. The screw 6 is preferably directly connected to the axle of the motor, but, of course, it is also feasible to arrange gears between the motor and the screw 6, if necessary. The screw 6 is supported by a supporting bearing 8 on the end next to the power unit 7. A nut 9 is fixedly secured to the end of the locking bow 1 to be inserted into the locking frame 2, the nut matching the screw 6. Further, a front bearing 10 is provided on the free end of the locking frame 2 in order to enable the locking bow 1 to move in a more precise and lighter manner. The bearing of the locking bow 1 can also be arranged such that the bearing is on the end of the locking bow 1. A plastic slide bearing, for example, can be used in both cases. The clothes rack of the invention further comprises means for controlling the power unit 7. At its simplest, when the power unit 7 is an electric motor, a solenoid or other such electric device, the power unit is controlled by a lockable switch 11, in which case by using a removable key or other such unlocking part that matches the switch 11, the power unit 7 is made to move the. locking bow 1 in the unlocking or locking direction via the moving elements. The clothes rack further comprises parts for limiting the pressing force and possibly for providing automatic unlocking and locking. In order to limit the pressing force and to switch off the driving force of the power unit 7, a limiter of the automatic fuse kind or other such electrotechnical solution, for example, can be used in connection with electric power devices. Correspondingly, in connection with power devices operating by means of a pressurized medium, a suitable valve solution can be used. When the locking bow 1 is pressed against the fastening frame 4 or against an object positioned between the fastening frame 4 and the locking bow 1 with a predetermined force, limiting parts switch off the driving force of the power unit 7, whereby the self-locking screw 6 serves to guarantee that the pressing continues independently of the power unit 7. The locking can be unlocked only by means of the power unit 7. The automatic unlocking and locking function, in turn, refers to the fact that by turning the unlocking part of the switch 11 or other such part, the clothes rack opens up to its extreme position, after which, the objects to be locked having been positioned in place, the unlocking part can be turned again, whereby the clothes rack is automatically locked and the unlocking part can be removed.

Since the locking bow now presses the garment to be locked against a substantially planar surface, moving the locking bow in the lateral direction does not substantially affect the pressing tightness and the locking. The counter surface, i.e. the fastening frame 4, of the locking bow is thus preferably plate-like and sufficiently large, unlike in the prior art solutions wherein the locking part is arranged to be pressed against a separate pin-like projection. When, in such solutions, the projection and the locking bow are bent in the lateral direction with respect to each other, the pressing is no longer sufficient. The present invention no longer suffers from such a disadvantage. It is to be further noted that in the present application, the substantially plate-like counter surface also refers to a somewhat convex or concave surface.

The clothes rack shown in the figure is used such that a garment is hung by its suspension loop or other such appropriate point from a hanger 12, or, in case the object is a bag or the like comprising suitable straps or loops, said loops can then be hung from the free end of the locking bow 1. After the objects are hung, a command can be given to the power unit 7 by means of the switch 11 to convey the locking bow 1 into a locking position. Other objects to be locked can also be simultaneously appropriately held against the fastening frame 4 by hand such that the locking bow 1, while moving into the locking position, presses the objects, together with the objects hung on the hanger 12, between the cushion 3 and the fastening frame 4. This enables also objects that cannot be hung on the hanger 12 or from the locking bow 1 to be locked in the clothes rack.

FIG. 2 is a front view of the clothes rack shown in FIG. 1. The clothes rack takes up extremely little fastening surface, and, similarly, the use of the clothes rack only necessitates a small space, which enables clothes racks of the invention to be arranged at a relatively short distance from each other. Particularly the fact that the clothes rack does not comprise any parts that turn in the lateral direction allows a compact and space-saving arrangement of the clothes racks. Furthermore, the critical locking parts are well protected, which makes the clothes rack thiefproof.

FIG. 3 is a partly sectional side view of a second embodiment of the clothes rack of the invention. The same numbers have the same significance as in the previous figures. Apart from the moving elements, the clothes rack shown in the figure is as shown in the previous figures, although no switch is shown in the figure. The motor serving as the power unit 7 is also differently positioned in the solution of the figure. The moving elements comprise a toothed wheel 13 connected to the motor directly or via gears, and a toothed bar 14 to match the toothed wheel 13 and attached to the locking bow 1 from its first end. The moving elements are, thanks to the gears, either such that the locking bow 1 cannot be unlocked independently of the motor, or, alternatively, the toothed wheel 13 and the toothed bar 14 are self-locking, i.e. the toothed bar 14 can only be moved by rotating the toothed wheel 13. The self-locking structure can be implemented, for example, by using the obliquely toothed wheel 13 and the obliquely toothed bar 14, respectively.

FIG. 4 is a partly sectional side view of a third embodiment of the clothes rack of the invention. The same numbers have the same significance as in the previous figures. Furthermore, the clothes rack shown in the figure basically corresponds to the clothes racks shown in the previous figures; however, the moving elements are different. The moving elements of the present embodiment comprise a rolling device 15 connected, directly or via possible gears, to the motor serving as the power unit 7, and a thin drive belt 16 connected to the locking bow 1 from its first end. The drive belt 16 is supported such that it can, in addition to the drive, also produce a pushing force without substantially being bent. The locking bow 1 is moved by rotating the rolling device 15 in a desired rotating direction via the motor, in which case, the drive belt 16 being attached to the locking bow 1 from its first end, the locking bow 1 is made to move in the desired direction and press the objects intended to be locked in the clothes rack against the fastening frame 4. The drive belt 16 is preferably made of a thin steel strip, but other elements suitable for the corresponding purpose can also be used.

The figures and the attached description are only intended to illustrate the inventive idea. The invention can vary in its details within the scope of the claims. Hence, the locking bow can also have a different shape than the U-shape. Furthermore, in addition to electric, pneumatic, or hydraulic motors, different cylinders, solenoids and other such devices generating a desired force can be used. The moving elements can also be mechanic solutions of other kind than those shown in the figures. It is also feasible that the power unit only moves the locking bow in the locking direction, whereby the locking bow locked in the locking position, thanks to the moving elements, can be unlocked by using the lock device which affects the locking of the moving elements, enabling the locking bow to be unlocked by pulling it. The hanger 12 is not necessary for the operation of the clothes rack, and its structure can also vary freely. An automatic charging device can be connected to the clothes rack for collecting money for the use of the clothes rack. If several clothes racks of the invention are used, they can share one charging device allowing the clothes rack to be locked to be selected in connection with the payment. It is further possible that the fastening frame is part of the wall structure or a larger clothes rack aggregate, for example.

What is claimed is:

1. A clothes rack for keeping garments, bags and other necessary objects, which clothes rack comprises a frame, a movable locking bow for connecting and locking the objects to the clothes rack, a substantially planar counter surface and transmission elements for moving the locking bow with respect to the fastening frame toward and away from said substantially planar counter surface, a power unit connected to the fastening frame, and wherein the power unit is arranged to generate a desired force to move the locking bow into a locking position by means of the transmission elements, and to press the locking bow against said substantially planar counter surface, whereby the object to be locked is lockable between said locking bow and said substantially planar counter surface.

2. A clothes rack as claimed in claim 1, wherein the transmission elements are such in structure that they are capable of keeping the locking bow in its locking position although the driving power of the power unit is switched off.

3. A clothes rack as claimed in claim 2, wherein the transmission elements comprise a screw arranged to be rotated by the power unit and a nut arranged on the end of the locking bow for moving the locking bow.

4. A clothes rack as claimed in claim 2, wherein the transmission elements comprise a toothed bar connected to the locking bow from its first end and a toothed wheel arranged to be rotated by the power unit for moving the locking bow.

5. A clothes rack as claimed in claim 2, wherein the transmission elements comprise a drive belt connected to the locking bow from its first end and supporting parts thereof, and a rolling device.

6. A clothes rack as claimed in claim 1, wherein the power unit is an electric motor.

7. A clothes rack as claimed in claim 1, wherein the clothes rack comprises a limiting device for adjusting the pressing force and further, a control device for enabling automatic unlocking and locking function of the locking bow.

8. A clothes rack as claimed in claim 1, wherein the clothes rack comprises a lockable switch and a matching unlocking part for using the power unit.

9. A clothes rack as claimed in claim 1, wherein the clothes rack comprises an automatic charging device.

* * * * *